US011130007B2

(12) United States Patent
Kokaisel et al.

(10) Patent No.: US 11,130,007 B2
(45) Date of Patent: Sep. 28, 2021

(54) BREATHING TUBE RETAINER AND METHOD OF USING SAME

(71) Applicant: 3M INNOVATIVE PROPERTIES COMPANY, St. Paul, MN (US)

(72) Inventors: Christopher R. Kokaisel, Woodbury, MN (US); Ian MacMurray, Darlington (GB)

(73) Assignee: 3M Innovative Properties Company, St. Paul, MN (US)

( * ) Notice: Subject to any disclaimer, the term of this patent is extended or adjusted under 35 U.S.C. 154(b) by 788 days.

(21) Appl. No.: 15/519,562

(22) PCT Filed: Oct. 8, 2015

(86) PCT No.: PCT/US2015/054620
§ 371 (c)(1),
(2) Date: Apr. 17, 2017

(87) PCT Pub. No.: WO2016/064587
PCT Pub. Date: Apr. 28, 2016

(65) Prior Publication Data

US 2017/0252586 A1 Sep. 7, 2017

Related U.S. Application Data

(60) Provisional application No. 62/068,058, filed on Oct. 24, 2014.

(51) Int. Cl.
*A62B 9/04* (2006.01)
*A62B 18/08* (2006.01)

(52) U.S. Cl.
CPC ..... *A62B 9/04* (2013.01); *A62B 18/08* (2013.01); *A62B 18/084* (2013.01)

(58) Field of Classification Search
CPC ..... A62B 18/084; A62B 18/08; A62B 9/04; A62B 7/10; A62B 7/12; A61M 16/0644; A61M 16/0683; B63C 2011/128
See application file for complete search history.

(56) References Cited

U.S. PATENT DOCUMENTS 4,979,659 A 12/1990 Boyd
D350,201 S 8/1994 Hirsch
(Continued)

FOREIGN PATENT DOCUMENTS

CN 3476083 9/2005
CN 203342230 12/2013
(Continued)

OTHER PUBLICATIONS

International Search report from PCT international Application No. PCT/US2015/054620 dated Feb. 9, 2016, 4 pages.

*Primary Examiner* — Samchuan C Yao
*Assistant Examiner* — Cana A Gallegos
(74) *Attorney, Agent, or Firm* — Steven A. Bern; Dena M. Ehrich

(57) ABSTRACT

Various embodiments of a breathing tube retainer and a respirator that utilizes the breathing tube retainer are disclosed. In one or more embodiments, the breathing tube retainer can include a mask attachment portion configured to connect the retainer to a face mask of a respirator, and a tube attachment portion including an arm that connects the tube attachment portion to the mask attachment portion. The tube attachment portion can further include a tube receiver configured to receive a breathing tube of the respirator.

19 Claims, 7 Drawing Sheets

(56) References Cited

U.S. PATENT DOCUMENTS

| | | | | |
|---|---|---|---|---|
| D360,030 | S | 7/1995 | Michels | |
| 5,924,420 | A * | 7/1999 | Reischel | A62B 18/08 128/206.21 |
| 6,044,844 | A * | 4/2000 | Kwok | A61M 16/06 128/207.11 |
| 6,575,165 | B1 | 6/2003 | Cook | |
| 6,666,209 | B2 | 12/2003 | Bennett | |
| D488,865 | S | 4/2004 | Todia | |
| 6,796,304 | B2 | 9/2004 | Odell et al. | |
| 6,837,239 | B2 | 1/2005 | Beizndtsson | |
| 6,854,694 | B1 | 2/2005 | Van Etten | |
| 7,320,447 | B1 | 1/2008 | Lynch | |
| D590,548 | S | 4/2009 | Johnson | |
| 7,568,484 | B2 | 8/2009 | Bierman | |
| 7,634,997 | B2 | 12/2009 | Shiue | |
| D608,882 | S | 1/2010 | Hitchcock | |
| 7,819,120 | B2 | 10/2010 | Taylor | |
| D683,847 | S | 6/2013 | Breckon | |
| D683,849 | S | 6/2013 | Breckon | |
| 2002/0011248 | A1* | 1/2002 | Hansen | A61M 16/0666 128/207.11 |
| 2003/0111076 | A1 | 6/2003 | Baker | |
| 2004/0182395 | A1 | 9/2004 | Brookman | |
| 2005/0022817 | A1 | 2/2005 | Alvey | |
| 2006/0231100 | A1 | 10/2006 | Walker | |
| 2007/0235033 | A1* | 10/2007 | Reier | A62B 18/084 128/207.11 |
| 2007/0272251 | A1 | 11/2007 | Hodge | |
| 2010/0037891 | A1 | 2/2010 | Walker | |
| 2011/0265790 | A1 | 11/2011 | Walker | |
| 2013/0037031 | A1 | 2/2013 | Gredat | |
| 2013/0068231 | A1* | 3/2013 | Chien | A62B 18/08 128/206.21 |
| 2015/0075523 | A1* | 3/2015 | Niewiadomski | A62B 9/04 128/202.27 |

FOREIGN PATENT DOCUMENTS

| | | |
|---|---|---|
| CN | 103505828 | 1/2014 |
| GB | 826198 | 12/1959 |
| GB | 1419841 | 12/1975 |
| GB | 2430159 | 3/2007 |
| JP | D1273518 | 6/2006 |
| JP | D1452389 | 10/2010 |
| JP | D1452390 | 10/2010 |
| JP | D1452302 | 10/2012 |
| WO | WO 2013-181080 | 12/2013 |

* cited by examiner

BREATHING TUBE RETAINER AND METHOD OF USING SAME

CROSS REFERENCE TO RELATED APPLICATIONS

This application is a national stage filing under 35 U.S.C. 371 of PCT/US2015/054620, filed Oct. 8, 2015, which claims the benefit of provisional Application No. 62/068,058, filed Oct. 24, 2014, the disclosure of which is incorporated by reference in its/their entirety herein.

BACKGROUND

Supplied air respirators are regularly worn in environments where the surrounding air contains contaminants. Clean air is delivered to the user from a supply tank or from a powered air source that drives the ambient air through an air filter.

Systems that use a powered air source to supply clean air to the user are referred to as powered air purifying respirators, i.e., "PAPRs." PAPRs typically have two main parts: a face mask and a filtering unit. The face mask is worn at least over the nose and mouth of the user (it also may cover the eyes and ears), and the filtering unit is commonly worn about the user's waist. The filtering unit often includes filter cartridges, a housing, a fan, and an electric motor that drives the fan. The fan and motor are contained within the housing, and the filter cartridges are attached to the housing body. Ambient air is filtered by being forced through filter elements that are contained within the filter cartridges. This filtered air is then delivered to the face mask through a breathing tube. The electrically powered fan drives the air from the filter cartridges, through the breathing tube, and into the interior of the face mask. Because the fan does the work required for air movement through the PAPR system, the user is able to comfortably receive a clean supply of air with little effort. Representative examples of known PAPRs are described in the following patents: U.S. Pat. No. 6,796,304 to Odell et al.; U.S. Pat. No. 6,575,165 to Cook et al.; U.S. Pat. No. 6,666,209 to Bennett et al.; and U.S. Pat. No. 6,837,239 to Beizndtsson et al.

Supplied air respirators that use a pressurized supply tank to provide clean air to the user are frequently referred to as self-contained breathing apparatus, i.e., "SCBAs." SCBAs also have a breathing tube that delivers clean air to a face mask from the clean air supply source. Examples of SCBAs are described in U.S. Patent Publication Nos. 2005/0022817 A1 to Alvey; 2004/0182395 A1 to Brookman; and 2003/0111076 A1 to Baker.

SUMMARY

In general, the present disclosure provides various embodiments of a breathing tube retainer and a respirator that includes such retainer.

In one aspect, the present disclosure provides a breathing tube retainer that includes a mask attachment portion configured to connect the retainer to a face mask of a respirator, and a tube attachment portion including an arm that connects the tube attachment portion to the mask attachment portion. The tube attachment portion further includes a tube receiver configured to receive a breathing tube of the respirator.

In another aspect, the present disclosure provides a supplied air respirator that includes a clean air supply source designed to be carried by a user of the supplied air respirator, a face mask sized to fit at least over the user's nose and mouth, a breathing tube configured to connect the clean air supply source to the face mask, and a breathing tube retainer. The breathing tube retainer includes a mask attachment portion connected to the face mask and a tube attachment portion including an arm that connects the tube attachment portion to the mask attachment portion. The tube attachment portion further includes a tube receiver, where the breathing tube is positioned within the tube receiver.

In another aspect, the present disclosure provides a method of using a respirator. The method includes attaching a breathing tube retainer to a face mask of the respirator, attaching a first end of the breathing tube to the face mask, and inserting a second end of the breathing tube through a passage of a tube receiver of the breathing tube retainer. The method further includes attaching the second end of the breathing tube to a clean air supply source, and placing the face mask over a nose and mouth of a user. The breathing tube extends from the face mask, over a shoulder of the user, and to the clean air supply source.

All headings provided herein are for the convenience of the reader and should not be used to limit the meaning of any text that follows the heading, unless so specified.

The terms "comprises" and variations thereof do not have a limiting meaning where these terms appear in the description and claims. Such terms will be understood to imply the inclusion of a stated step or element or group of steps or elements but not the exclusion of any other step or element or group of steps or elements. The term "consisting of" means "including," and is limited to whatever follows the phrase "consisting of" Thus, the phrase "consisting of" indicates that the listed elements are required or mandatory and that no other elements may be present. The term "consisting essentially of" means including any elements listed after the phrase, and is limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they materially affect the activity or action of the listed elements.

The words "preferred" and "preferably" refer to embodiments of the disclosure that may afford certain benefits, under certain circumstances; however, other embodiments may also be preferred, under the same or other circumstances. Furthermore, the recitation of one or more preferred embodiments does not imply that other embodiments are not useful, and is not intended to exclude other embodiments from the scope of the disclosure.

In this application, terms such as "a," "an," and "the" are not intended to refer to only a singular entity, but include the general class of which a specific example may be used for illustration. The terms "a," "an," and "the" are used interchangeably with the term "at least one." The phrases "at least one of" and "comprises at least one of" followed by a list refers to any one of the items in the list and any combination of two or more items in the list.

The phrases "at least one of" and "comprises at least one of" followed by a list refers to any one of the items in the list and any combination of two or more items in the list.

As used herein, the term "or" is generally employed in its usual sense including "and/or" unless the content clearly dictates otherwise.

The term "and/or" means one or all of the listed elements or a combination of any two or more of the listed elements.

As used herein in connection with a measured quantity, the term "about" refers to that variation in the measured quantity as would be expected by the skilled artisan making the measurement and exercising a level of care commensurate with the objective of the measurement and the precision of the measuring equipment used. Herein, "up to" a number (e.g., up to 50) includes the number (e.g., 50).

Also herein, the recitations of numerical ranges by endpoints include all numbers subsumed within that range as well as the endpoints (e.g., 1 to 5 includes 1, 1.5, 2, 2.75, 3, 3.80, 4, 5, etc.).

Glossary

The terms set forth herein will have the meanings as defined:

"breathing tube" means a tube, hose, or conduit that extends from a clean air supply source to a face mask of a respirator to provide clean air to a user;

"breathing zone" means the portion of an interior gas space were clean air is inhaled by a wearer of a supplied air respirator;

"clean air" means air (or other oxygen-containing gas) that has been filtered or that has otherwise been made safe to breathe for providing oxygen to a person;

"clean air supply source" means an apparatus, such as a filtering unit or tank, that is capable of providing a supply of clean air (or oxygen) for person to safely breathe;

"compliant face contacting member" means the portion of a face mask that is compliantly fashioned for allowing the mask body to be comfortably supported over a person's nose and mouth;

"extends or extends from" means that the breathing tube is located somewhere between the clean air supply source and the face mask to assist in allowing fluid communication to occur between such parts (the breathing tube does not need to be directly attached at either end to such parts);

"exterior gas space" means the ambient atmospheric gas space that surrounds a face mask when worn on a person and that ultimately receives exhaled gas after it exits the interior gas space of a mask;

"face mask" means a device that is worn by a user over at least the respiratory passages (nose and mouth) of the user to help create an interior gas space separate from an exterior gas space;

"filter cartridge" means a structure that includes a filter element and that is adapted for connection to or use in a filtering unit;

"filtering unit" means the portion of a supplied air respirator that is responsible for filtering ambient air and causing powered air movement;

"integral" means being manufactured together at the same time; that is, being made together as one part and not two separately manufactured parts that are subsequently joined together;

"interior gas space" means the space that exists between a mask body and a user's face when the mask is being worn;

"mask body" means a structure that can fit at least over the nose and mouth of a user and that can help define an interior gas space separate from an exterior gas space;

"powered air purifying respirator or PAPR" means a supplied air respirator that uses an external power source to deliver filtered air to the breathing zone of an interior gas space;

"self-containing breathing apparatus" or SCBA means a supplied air respirator that has a pressurized bottle or tank in which a supply of clean air is stored; and "supplied air respirator" means a device that is capable of delivering a supply of clean air to a user of the device.

BRIEF DESCRIPTION OF THE DRAWINGS

Throughout the specification, reference is made to the appended drawings, where like reference numerals designate like elements, and wherein.

DETAILED DESCRIPTION

Figure 1:
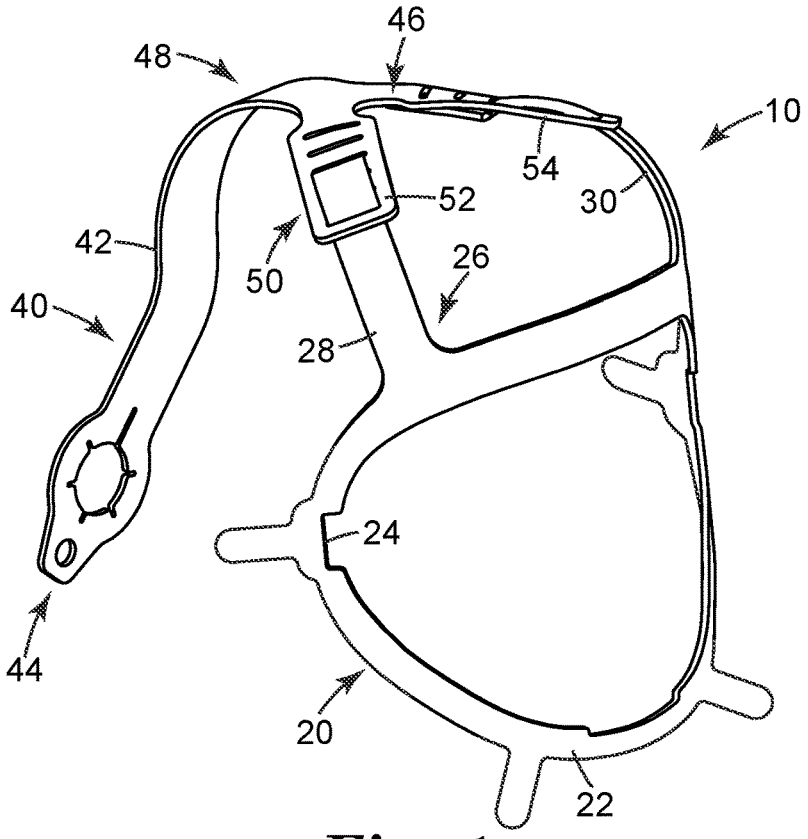
FIG. 1 is a perspective view of one embodiment of a breathing tube retainer.

In general, the present disclosure provides various embodiments of a breathing tube retainer and a respirator that includes such retainer.

For personal safety equipment where filtered or unfiltered passive or powered air is delivered to a full, partial/half mask, or other head worn apparatus, one or more embodiments of a breathing tube retainer can provide retention, location, and tension adjustment of single or multiple breathing tubes that extend between a clean air supply source and head-worn face mask. The breathing tube retainer can be configured or designed to connect to the face mask. For example, in one or more embodiments, the retainer can connect to a mask body of the face mask. Further, the retainer can, in one or more embodiments, provide the user with the ability to manage and distribute the weight and tension of the breathing tube(s) and provide optimal comfort for the user. It is believed that the more comfortable a respirator is to wear, the more likely that users will adopt the proper use of the respirator.

In work environments where personal safety equipment such as a supplied air respirator is used to protect the health of the worker from harmful airborne contaminants and vapors, a breathing tube or tubes can be employed to deliver filtered air to a partial or full sealed face mask. The length of these breathing tubes are often designed as a one-size-fits-all length, which usually means an excess of tubing for all but the largest biometric percentile users, the excess length of the breathing tube may need to be managed. In one or more embodiments, the breathing tube retainer can be attached to the face mask and can assist in managing the breathing tube(s) for improved user comfort and safety, e.g., by securing the tube flexibly to a point near the base of the neck but suspended above or over the shoulder.

In instances where the breathing tube(s) are routed over the shoulder, one or more embodiments of the disclosed breathing tube retainers can secure the breathing tube and prevent it from falling off the shoulder while allowing for full freedom of neck movement. Further, in one or more embodiments, the breathing tube retainer can balance the load between the weight limits allowed for the front of the face mask by changing/managing the location and direction of the loading. In addition, one or more embodiments of the breathing tube retainer can keep the retention location of the tube as close as possible to an axis of rotation at the base of the neck but still be suspended over the user's shoulder. This positioning can have the effect of minimizing changes in tension as the user rotates his head to look left, right, up, or down. The breathing tube retainer can be indexed to a specific location on the breathing tube and allow the user to change the retainer holding position along the tube to adjust the balance of breathing tube tension between the retainer and the face mask versus the retainer and the clean air supply source worn by the user.

In one or more embodiments, the breathing tube retainer can accommodate the use of a hooded coverall as the retainer can be connected or attached to an exposed portion of a mask body of a face mask and can allow the user to tuck the hood extents around the face under the retainer. The breathing tube retainer can be worn outside and over the hood of the coverall.

Various embodiments of the breathing tube retainer can be implemented with single or multiple breathing tube configurations, with different tube receiver configurations depending on the need for more retention or quick release of the tube from the retainer. Additionally, in one or more embodiments, a multi-part design can include a load-tuned separation release. In such embodiments, the load-tuned separation release can be adjusted such that a specific release force is achieved.

The breathing tube retainers described herein can be manufactured using any suitable technique or combination of techniques. For example, injection molding could be utilized to form the retainer and to add additional features or functionality to the retainer assembly. Alternatively, steel rule die or laser conversion of flat roll sheet stock could also be utilized where a simpler 2D design may be sufficient.

Figure 2:
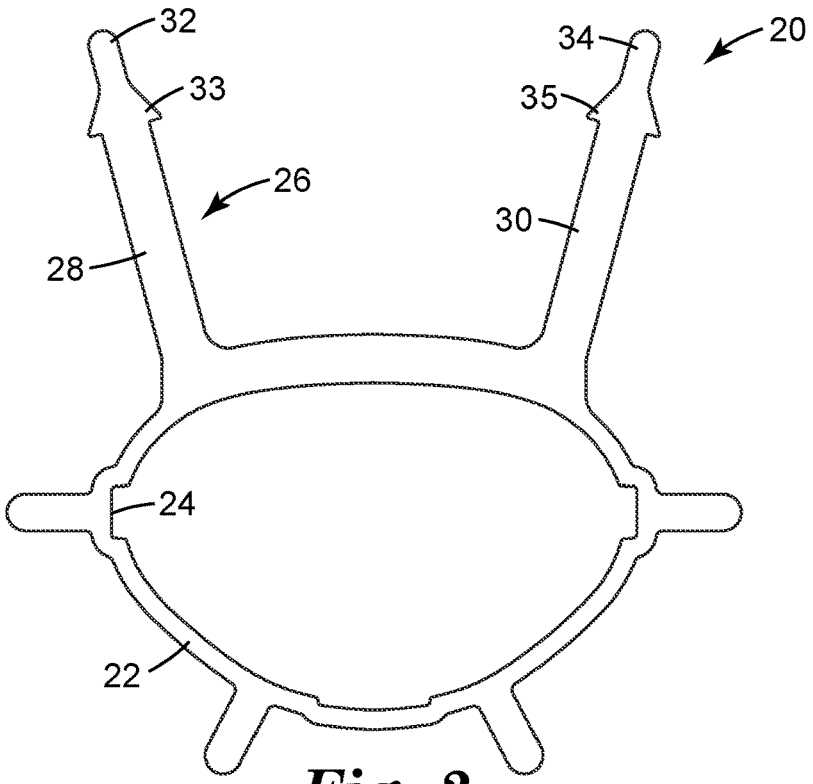
FIG. 2 is a schematic plan view of a mask attachment portion of the breathing tube retainer of FIG. 1.
Figure 3:
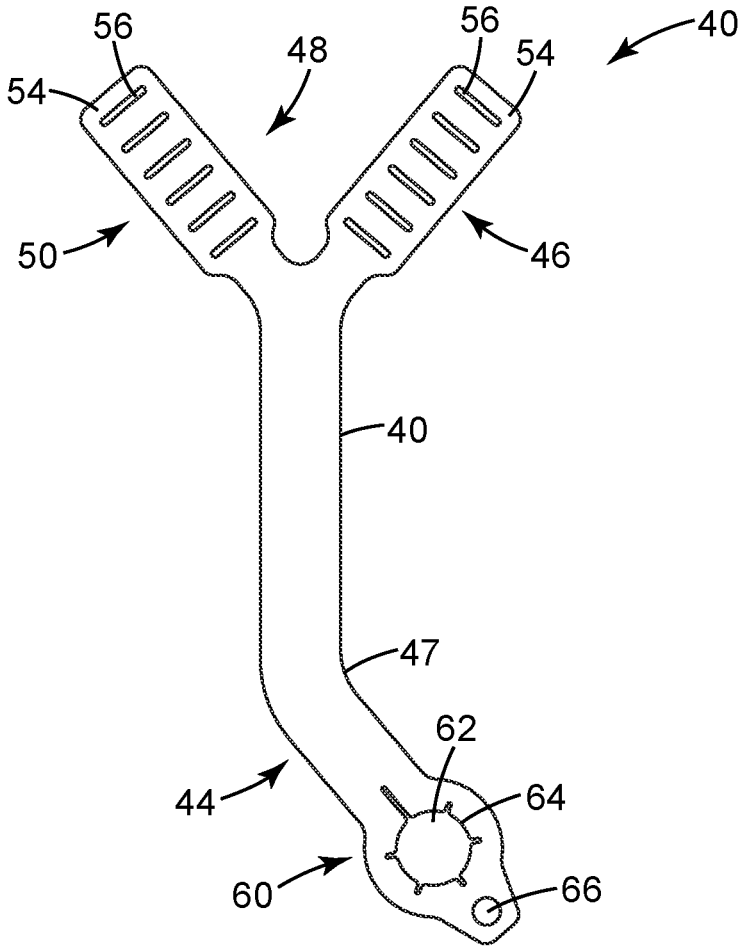
FIG. 3 is a schematic plan view of a tube attachment portion of the breathing tube retainer of FIG. 1.

FIGS. 1-3 are schematic views of one embodiment of a breathing tube retainer 10. The breathing tube retainer 10 includes a mask attachment portion 20 and a tube attachment portion 40. In one or more embodiments, the mask attachment portion 20 can be configured to connect the retainer 10 to a face mask of a respirator as is further described herein. In one or more embodiments, the retainer 10 can be configured to position the breathing tube adjacent a shoulder and/or neck of a user of the respirator. As used herein, the phrase "adjacent a shoulder" means that an element or device is positioned closer to the shoulder of the user then to a torso of the user. In one or more embodiments, the retainer 10 can be configured to position the breathing tube above a shoulder of a user of the respirator such that the breathing tube does not touch the shoulder when the respirator is worn by the user as is further described herein.

In one or more embodiments, the mask attachment portion 20 can be integral with the tube attachment portion 40. Alternatively, the mask attachment portion 20 and tube attachment portion 40 can be separate portions of the retainer 10 that are attached using any suitable technique or combination of techniques, e.g., buckles, straps, tabs, hook-and-loop fasteners, snaps, etc. Further, the mask attachment portion 20 and the tube attachment portion 40 can be attached using a load-tuned separation release. Any suitable load-tuned separation release can be utilized.

In one or more embodiments, the mask attachment portion 20 can be configured to connect the retainer 10 to a face mask of a respirator using any suitable technique or combination of techniques. In one or more embodiments, the mask attachment portion 20 can be attached to a lens of a mask body of the face mask. For example, the mask attachment portion 20 can be attached to a perimeter of the lens of the mask body using any suitable technique or combination of techniques. In the embodiment illustrated in FIGS. 1-3, the mask attachment portion 20 includes a ring 22 configured to engage a perimeter of the lens of the mask body of the respirator and fix the retainer 10 to the mask. Ring 22 may be formed of a resilient material that may be stretched and/or enlarged as it is positioned around the perimeter of the lens of the mask body. In an exemplary embodiment, at least portions of ring 22 are in tension and act to secure mask attachment portion 20 in position on the mask body. The ring 22 of the mask attachment portion 20 can include one or more notches 24 that engage tabs of the perimeter of the face mask. In one or more alternative embodiments, the mask attachment portion 20 can attach to the face mask in any suitable location. For example, in one or more embodiments, the mask attachment portion 20 can attach the retainer 10 to a harness of the face mask.

In one or more embodiments, the mask attachment portion 20 can include first and second straps 28, 30 configured to attach the mask attachment portion to the tube attachment portion 40 at one or more strap receivers 50 of the tube attachment portion as is further described herein. In the embodiment illustrated in FIGS. 1-3, the first and second straps 28, 30 of the mask attachment portion 20 are configured to extend along a top portion of a head of a user. In one or more alternative embodiments, the first and second straps 28, 30 can be configured to extend along left and right side portions of the head of the user as is described, e.g., in the embodiment illustrated in FIG. 7. Further, in one or more embodiments, the first and second straps 28, 30 can be configured to extend along any portion or portions of the head of the user.

The mask attachment portion 20 can include any suitable material or combination of materials. For example, the mask attachment portion 20 can include at least one of a polymeric, rubber, textile, non-woven, leather, or metal material, or combinations thereof. The mask attachment portion 20 can be manufactured using any suitable technique or combination of techniques, e.g., die cutting, laser cutting, injection molding, compression molding, etc.

Further, the mask attachment portion 20 can take any suitable shape or combination of shapes and include any suitable dimensions. In one or more embodiments, the mask attachment portion 20 along with the tube attachment portion 40 can be sized such that the breathing tube retainer 10 extends from the face mask or other attachment point to the face mask, over the head of the user, and down the back of the neck of the user such that the retainer can retain a breathing tube of a respirator adjacent the base of the neck of the user and/or shoulder of the user. As used herein, the phrase "adjacent the base of the neck" means that an element or device is positioned closer to the neck of the user then to the head of the user.

Attached or connected to the mask attachment portion 20 is the tube attachment portion 40. The tube attachment portion 40 includes an arm 42 that connects the tube attachment portion to the mask attachment portion 20. The arm 42 can take any suitable shape or combination of shapes and can include any suitable dimensions. In one or more embodiments, the arm 42 can include a bend 47 such that the arm extends from the head of the user, down a central axis of the head and neck, and then extend either towards the right or left shoulder of the user such that the retainer can retain the breathing tube of the respirator on either side of the base of the neck of the user. In the embodiment illustrated in FIGS. 1-3, the arm 42 includes the bend 47 adjacent a first end 44 of the arm such that the breathing tube can be positioned adjacent a right shoulder of the user. As used herein, the phrase "adjacent a first end of the arm" means that an element or device is positioned closer to the first end of the arm than to the second end of the arm. Alternatively, the user can rotate an orientation of the tube attachment portion 40 such that arm 42 extends towards the left shoulder of the user.

The arm 42 can connect the tube attachment portion 40 to the mask attachment portion 20 using any suitable technique or combination of techniques, e.g., buckles, hook-and-loop fasteners, snaps, straps etc. For example, in one or more embodiments, the arm 42 can include an adjustable buckle configured to connect the tube attachment portion 40 to the mask attachment portion 20. In the embodiment illustrated in FIGS. 1-3, the arm 42 includes a y-portion 48 including one or more strap receivers 50 configured to receive straps of the mask attachment portion 20.

Specifically, the y-portion 48 includes first and second strap receivers 52, 54 that are configured to receive first and second straps 28, 30 of the mask attachment portion 20. The first and second strap receivers 52, 54 can be adjustable such that a length of the breathing tube retainer 10 can be adjusted by the user. The y-portion 48 can be disposed adjacent a second end 46 of the arm 42. As used herein, the phrase "adjacent a second end of the arm" means that an element or device is positioned closer to the second end of the arm than to the first end 44 of the arm. Further, the first and second strap receivers 52, 54 can also be disposed adjacent the second end 46 of arm 42. One or both of the first and second strap receivers 52, 54 can include one or more slots 56 configured to receive tab 32 of first strap 28 and tab 34 of second strap 30 of mask attachment portion 20. Further, one or both of the first and second straps 20, 30 of the mask attachment portion 20 can include barbs 33, 35 that each includes a width that is greater than a width of slots 56 of the strap receivers 52, 54 such that the straps remain attached to the strap receiver of the tube attachment portion 40 after the strap and barb are fed through a slot.

In one or more embodiments, the barbs 33, 35 can provide load-tuned separation release elements such that the mask attachment portion 20 becomes disengaged from the tube attachment portion 40 for a predetermined load. For example, the materials of the straps 20, 30 and the dimensions of the barbs 33, 35 and the slots 56 can be designed such that the barbs disengage from the slots when the breathing tube is under a predetermined load. In one or more embodiments, this load-tuned separation feature can prevent a user from becoming trapped or injured when the breathing tube of a respirator engages elements of a work environment, e.g., the tube snags rebar. The tube retention portion 40 disengages from such work environment elements before the face mask of the respirator assembly becomes dislodged from the user's face, thereby maintaining a seal against the face.

The tube attachment portion 40 also includes a tube receiver 60. The tube receiver 60 can be configured to receive the breathing tube of the respirator. The tube receiver 60 can be disposed in any suitable location along the arm 42. In one or more embodiments, the receiver 60 is disposed adjacent the first end 44 of the arm 42.

The tube receiver 60 can include any suitable configuration such that the breathing tube of the respirator can be retained by the breathing tube retainer 10 as is further described herein. In one or more embodiments, the tube receiver 60 can include a passage 62 configured to receive the breathing tube of the respirator. In one or more embodiments, the passage 62 is configured such that it slidably retains the breathing tube. In other words, the tube receiver 60 is configured such that the breathing tube can be inserted into the passage 62 and slid through the passage to a desired position. In the embodiment illustrated in FIGS. 1-3, the tube receiver 60 includes one or more fingers or tabs 64 that can engage the breathing tube. For example, one or more embodiments of a breathing tube can include a corrugated outer structure such that the breathing tube is flexible. In such embodiments, the fingers 64 can engage the corrugations of the breathing tube and retain the breathing tube within the passage 62 of the tube receiver 60 such that the breathing tube is fixed and does not move in an axial direction in relation to the passage.

The tube attachment portion 40 can also include an opening 66. This opening 66 can be utilized to aid the user in securely gripping the tube receiver 60 such that the user can position the breathing tube within the passage 62. In one or more embodiments, the tube attachment portion 40 can use any suitable element or combination of elements disposed on the tube receiver 60 that provides a secure grip to the user, e.g., pull tabs, knotted cord fed through and attached to opening 66, etc.

The tube attachment portion 40 can include any suitable material or combinations of materials, e.g., the same materials utilized for the mask attachment portion 20. In one or more embodiments, the tube attachment portion 40 can include the same materials as the mask attachment portion 20. In one or more alternative embodiments, the tube attachment portion 40 can include materials that are different from the materials utilized for the mask attachment portion 20. And as mentioned herein, the tube attachment portion 40 can be integral with the mask attachment portion 20.

In general, one or both of the mask attachment portion 20 and the tube attachment portion 40 can include a material or combination of materials with any suitable properties. In one or more embodiments, one or both of the mask attachment portion 20 and the tube attachment portion 40 can include flexible materials such that the breathing tube retainer 10 exhibits a desired amount of flexibility when under a given load from the breathing tube. Further, the materials of one or both of the mask attachment portion 20 and the tube attachment portion 40 can provide the retainer 10 with any suitable amount of resiliency such that the retainer returns to its original shape once the load from the breathing tube has been reduced or eliminated. Further, the mask attachment portion 20 and the tube attachment portion 40 can be manufactured such that, in one or more embodiments, the retainer 10 exhibits a suitable amount of tensile strength such that a position of the breathing tube in relation to the user is maintained, e.g., the breathing tube is suspended above a shoulder of the user adjacent a neck of the user.

The various embodiments of breathing tube retainers described herein can be utilized with any suitable respirator. In general, respirators that use a powered air source to supply clean air to the wearer are referred to as powered air purifying respirators, i.e., "PAPRs." PAPRs typically have two main parts: a face mask and a clean air supply source. The face mask can be worn at least over the nose and mouth of the user (it also may cover the eyes and ears), and the clean air supply source can be worn about the user's waist. The clean air supply source can include a filtering unit that can include filter cartridges, a housing, a fan, and an electric motor that drives the fan. The fan and motor are contained within the housing, and the filter cartridges are attached to the housing body. Ambient air is filtered by being forced through filter elements that are contained within the filter cartridges. This filtered air is then delivered to the face mask through a breathing tube. The electrically powered fan drives the air from the filter cartridges, through the hose, and into the face mask interior. Because the fan does the work required for air movement through the PAPR system, the user is able to comfortably receive a clean supply of air with little effort.

Figure 4:
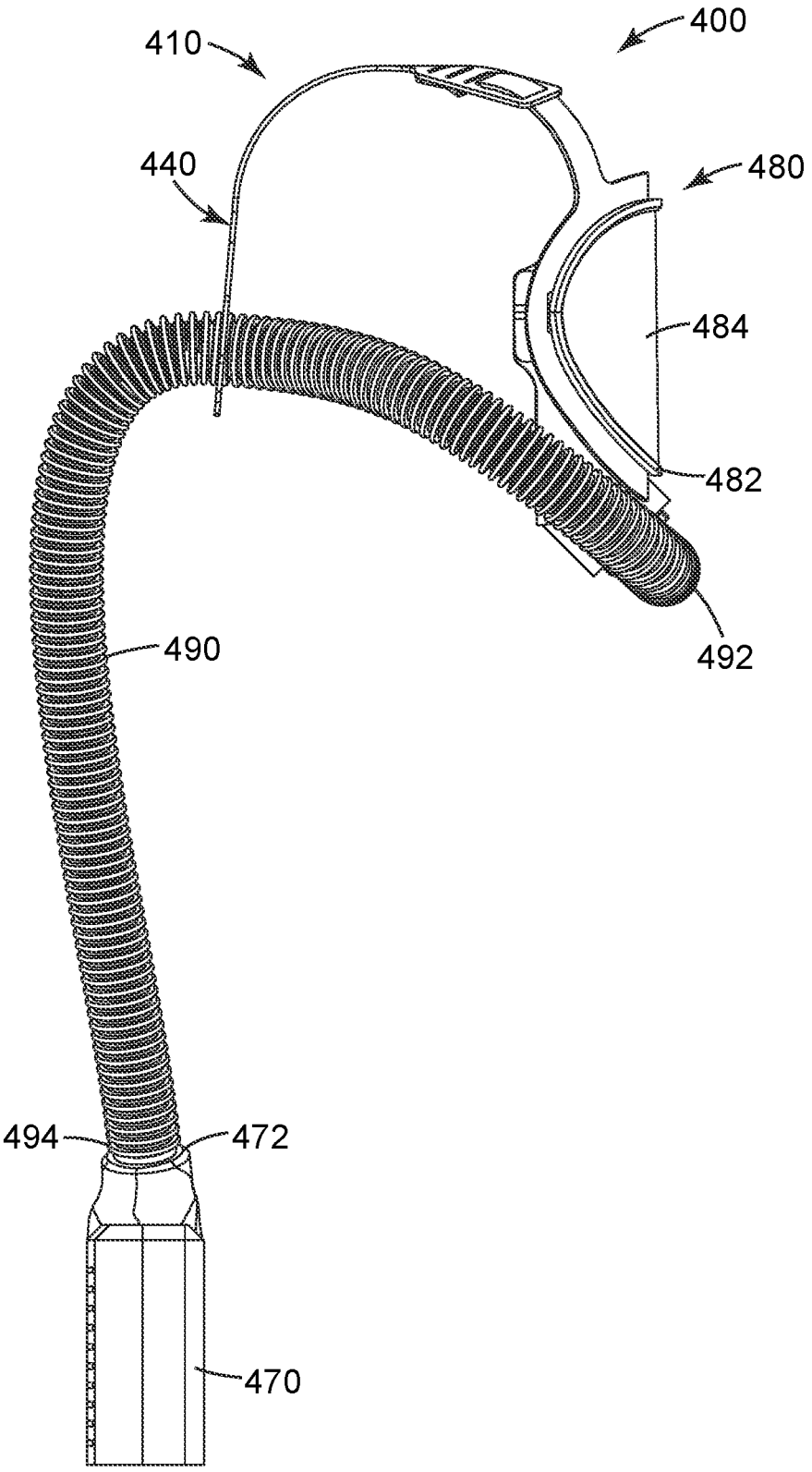
FIG. 4 is a schematic right side view of a respirator that includes a breathing tube retainer.
Figure 5:
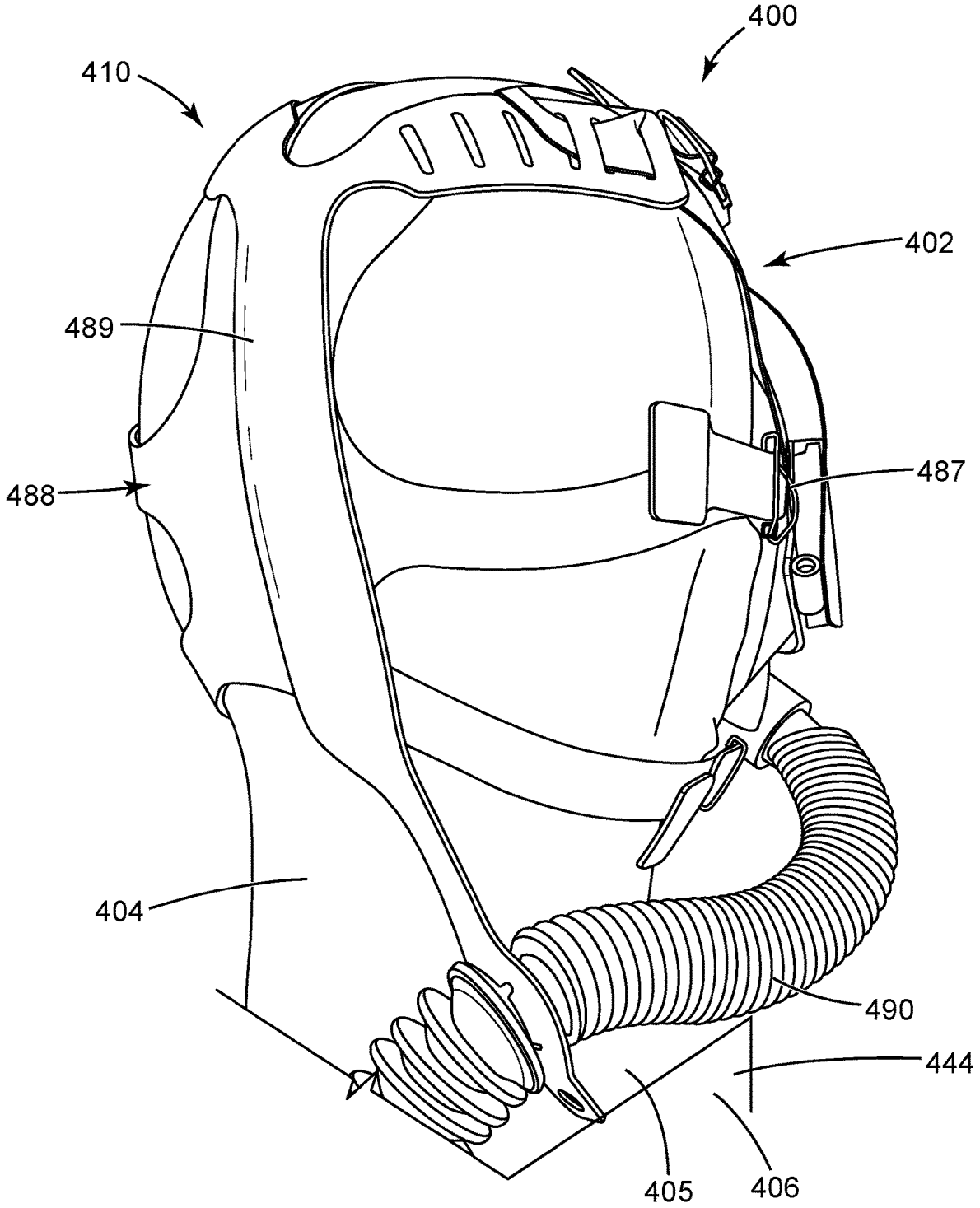
FIG. 5 is a schematic rear view of the respirator of FIG. 4.

FIGS. 4-5 are various schematic views of one embodiment of a supplied air respirator 400. The respirator 400 can include any suitable supplied air respirator. In one or more embodiments, the respirator 400 includes a clean air supply source 470 designed to be carried by a user of the supplied air respirator, and a face mask 480 sized to fit at least over the user's nose and mouth. The respirator 400 can also include a breathing tube 490 configured to connect the clean air supply source 470 to the face mask 480. In one or more embodiments, a first end 492 of the breathing tube 490 can be attached to the face mask 480 at a port 486. And a second end 494 of the breathing tube 490 can be attached to the clean air supply source 470 at a port 472. Further, the respirator 400 can include a breathing tube retainer 410. Any suitable breathing tube retainer can be utilized with the respirator 400, e.g., breathing tube retainer 10 of FIGS. 1-3. All of the design considerations and possibilities regarding the breathing tube retainer 10 of FIGS. 1-3 apply equally to the breathing tube retainer 410 of FIGS. 4-5.

The clean air supply source 470 can be any suitable source. In one or more embodiments, the clean air supply source 470 can be designed to be carried by a user of the supplied air respirator 400. In one or more alternative embodiments, the clean air supply source 470 can be a central source that remains in place while the user is connected or tethered to the source by at least the breathing tube 490. The clean air supply source 470 can be operable to provide clean air to the user through the breathing tube 490 and the facemask 480. The clean air supply source 470 can be connected to the user through a waist belt or an over-the-shoulder harness as is known in the art. See, e.g., U.S. Pat. No. 7,819,120 to Taylor et al.

Attached to the clean air supply source 470 via the breathing tube 490 is the face mask 480. The face mask 480 can include any suitable face mask. In one or more embodiments the face mask can be sized to fit at least over the user's nose and mouth. See, e.g., U.S. Pat. No. 5,924,420 to Reischel et al. In one or more embodiments, the face mask 480 can cover either the nose or the mouth of the user. Further, in one or more embodiments, the face mask 480 can at least cover the nose, mouth, and eyes of the user. The face mask 480 can include a compliant face contacting member (not shown), a mask body 481, a harness 488, and one or more harness strap receiving structures 487 located on the mask body for receiving one or more straps 489 of the harness. The harness 488 enables the face mask 480 to be supported on a user's head.

The mask body 481 can include at least one exhalation port (not shown) that allows exhaled air to be exhausted from the interior gas space. The interior gas space is defined as the space between the mask body and a user's face. An exhalation valve (not shown) can be provided on the mask body 481 to preclude air from entering the interior gas space during an inhalation, while also allowing exhaled air to be rapidly exhausted from that space during an exhalation. Examples of exhalation valves that could be used in connection with respiratory assemblies of the present disclosure include those having a flexible flap that dynamically opens in response to exhaled air.

In one or more embodiments, the face mask 480 can include a lens 484. The lens 484 can include a perimeter 482 and can be attached to the mask body 481 of the face mask 480. The mask body 481 and the lens 484 can take any suitable shape or combination of shapes and can have any suitable dimensions. Further, the mask body 481 and the lens 484 can include any suitable material or combination of materials.

Although the supplied air respirator 400 includes a face mask 480 that provides an interior gas space separate from an exterior gas space, a supplied air system could also use a hood as a face mask that provides the interior gas space as described, e.g., in U.S. Patent Publication No. 2006/0231100 to Walker et al.

The respirator 400 can include any suitable breathing tube 490. In one or more embodiments, the breathing tube 490 is configured to connect the clean air supply source 470 to the face mask 480. The breathing tube 490 can include any suitable material or combination of materials. For example, the breathing tube 490 may be made from a plastic material that is disposed over a spirally wound cord. See, e.g., UK Patent No. 1,419,841. This kind of breathing tube can be flexible and can tend to exhibit resistance to axial compression. The breathing tube 490 is formed in such a way that displays a tendency to expand in the axial direction if compressed from its naturally extended state. Conversely, if the breathing tube 490 is extended axially by exerting tension on it, it has a tendency to compress to return to its naturally extended state. The spirally wound cord provides shape and structural integrity to the tube 490 and allows it to be extended or compressed as needed. Alternatively, the tube could be a flexible, molded convoluted hose. The first end 492 of tube 490 can have, for example, a quick release swivel (Q. R. S.) adapter on it so that the hose 490 can be attached to the face mask 480. The second end 494 of the breathing tube 490 can have a bayonet fitting for being secured to the clean air supply source 470. Other adapters or fittings may be used as desired.

In the embodiment illustrated in FIGS. 4-5, the breathing tube retainer 410 is attached to the face mask 480 at the perimeter 482 of the lens 484 such that the retainer is fixed to the mask. Specifically, the retainer 410 includes a mask attachment portion 420 that includes a ring 422 that is configured to engage the perimeter 482 of the lens 484 of the mask body 481 and connect the retainer to the mask 480.

The retainer 410 also includes a tube attachment portion 440. The tube attachment portion 440 includes an arm 442 that connects the tube attachment portion to the mask attachment portion 420. The tube attachment portion 440 includes a tube receiver 460 configured to receive the breathing tube 490 of the respirator 400 through a passage 462.

FIG. 5 is a schematic perspective view of the respirator 400 of FIG. 4 as worn by a user. In one or more embodiments, the retainer 410 is configured to position the breathing tube 490 above or over a shoulder 406 of the user of the respirator 400 such that the breathing tube does not touch or contact the shoulder when the respirator is worn by the user. Further, in one or more embodiments, the retainer 410 is configured to be positioned over a head 402 of the user of the respirator 400. In one or more embodiments, the breathing tube retainer 410 is configured to retain the breathing tube 490 such that the tube extends from the face mask 480, over the shoulder 406 of the user adjacent a base 405 of a neck 404 of the user, and down a back of the user (not shown) when the respirator 400 is worn by the user.

Because the breathing tube retainer 410 is attached to the face mask 480 of the respirator 400, the user can wear a protective suit over the head, and the face mask and the breathing tube retainer can be applied over the protective suit.

The various embodiments of breathing tube retainers described herein can be utilized in any suitable matter. For example, in reference to respirator 400 of FIGS. 4-5, the breathing tube retainer 410 can be attached to the face mask 480 of the respirator using any suitable technique or combination of techniques. For example, the first end 492 of the breathing tube 490 can be attached to the face mask 480. The second end 494 of the breathing tube 490 can be inserted through the passage 462 of the tube receiver 460 of the breathing tube retainer 410. The second end 494 of the tube 490 can be attached to the clean air supply source 470 of the respirator 400. Alternatively, the second end 494 of the breathing tube 490 can be attached to the clean air supply source 470, and the first end 492 can be inserted through the passage 462 and attached to the face mask 480. The face mask 480 can be placed over the nose and mouth of the user, where the breathing tube 490 extends from the face mask, over the shoulder 406 of the user, and to the clean air supply source 470. In one or more embodiments, the breathing tube 490 is positioned over the shoulder 406 and base 405 of the neck 404 of the user. Alternatively, the face mask 480 can be placed at least over the nose and mouth of the user, and the breathing tube can then be attached to the face mask and the clean air supply source 470.

Figure 6:
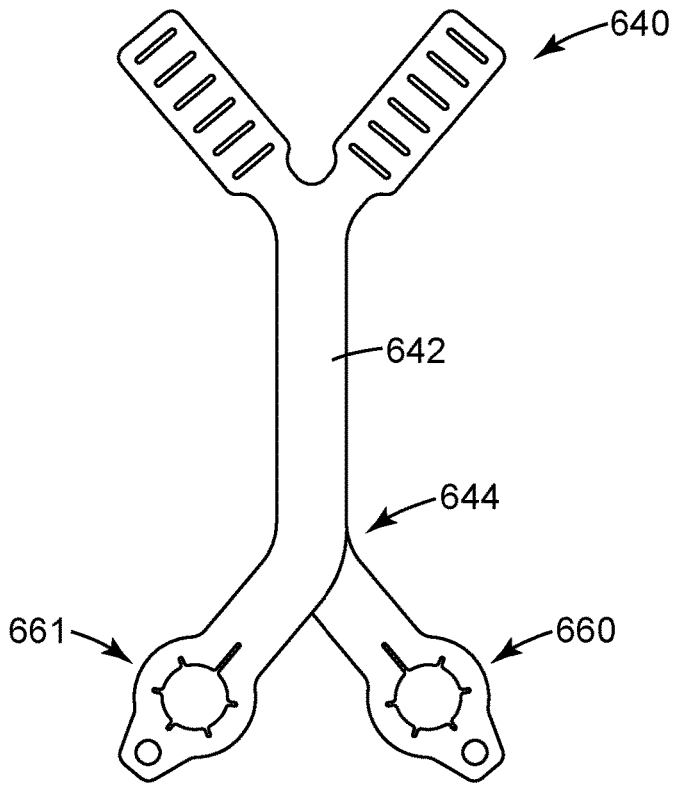
FIG. 6 is a schematic plan view of another embodiment of a tube attachment portion of a breathing tube retainer.

As mentioned herein, the various embodiments of the disclosed breathing tube retainers can retain a breathing tube of a respirator such that it remains in a fixed position relative to the user's body. The various breathing tube retainers can be utilized with any suitable respirator system. Some systems may include more than one breathing tube. In such systems, the breathing tube retainer can include two or more tube receivers configured to receive two or more of the breathing tubes of the respirator. For example, FIG. 6 is a schematic plan view of one embodiment of a tube attachment portion 640 of a breathing tube retainer. The tube attachment portion 640 can be utilized with any breathing tube retainer described herein, e.g., breathing tube retainer 10 of FIGS. 1-3. All of the design considerations and possibilities regarding the tube attachment portion 40 of FIGS. 1-3 apply equally to the tube attachment portion 640 of FIG. 6.

One difference between tube attachment portion 40 and tube attachment portion 640 is that portion 640 includes first and second tube receivers 660, 661. The first and second tube receivers 660, 661 are disposed adjacent a first end 644 of arm 642 of the tube attachment portion 640. The tube receivers 660, 661 can include any suitable configuration, e.g., the same configurations described regarding tube receiver 60 of retainer 10 of FIGS. 1-3. In one or more embodiments, the first and second tube receivers 660, 661 can be figured to retain a first breathing tube and a second breathing tube of a respirator (not shown). The first and second breathing tubes can flank the head of the user and both be attached to the face mask and then joined together at a y-portion of a larger breathing tube at the back of the head and neck of the user. In one or more embodiments, the first and second tube receivers 660, 661 can be positioned on the tube attachment portion 640 such that the first tube receiver is disposed adjacent a right shoulder of a user and the second tube receiver 661 is disposed adjacent a left shoulder of the user. In such embodiments, the tube attachment portion 640 is configured to retain the first breathing tube in a position adjacent the right shoulder of the user and the second breathing tube adjacent the left shoulder of the user such that the first tube is adjacent a right side of the user's neck and the second tube is adjacent the left side of the user's neck. In one or more alternative embodiments, the first and second tube receivers are 660, 661 can be disposed such that they are both adjacent either the right shoulder or the left shoulder of the user. In such embodiments, both the first and second breathing tubes can be retained adjacent the same shoulder of the user, e.g., the right shoulder.

Figure 7:
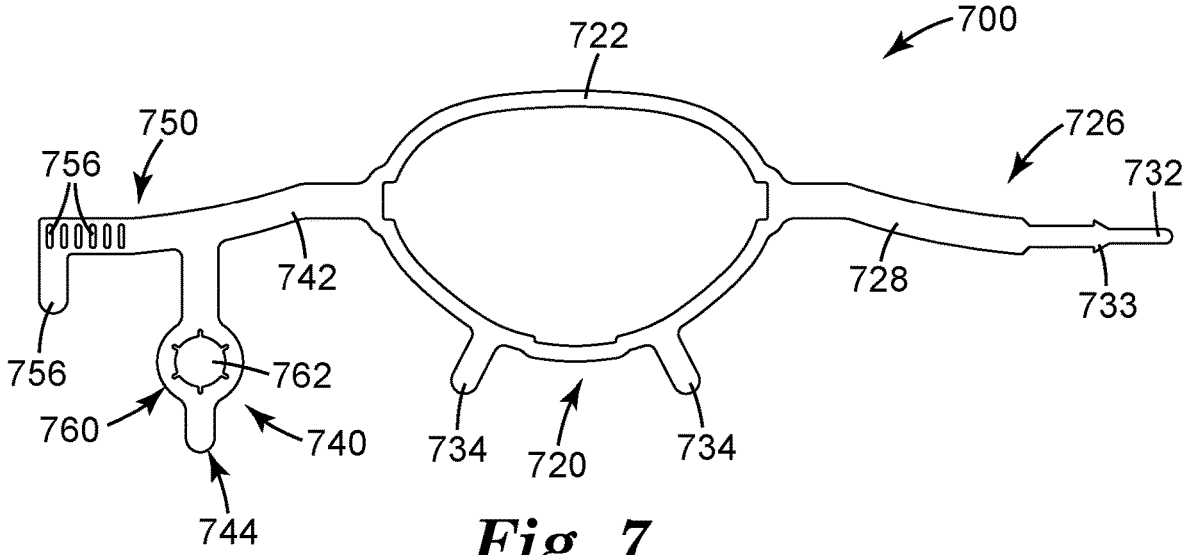
FIG. 7 is a schematic plan view of another embodiment of a breathing tube retainer.

In one or more embodiments, a breathing tube retainer can be configured such that the straps of the mask attachment portion and/or the arm of the tube attachment portion can extend over any portion of a head of a user. For example, FIG. 7 is a plan view of another embodiment of a breathing tube retainer 700. All of the design considerations and possibilities regarding the breathing tube retainer 100 of FIGS. 1-3 apply equally to the breathing tube retainer 700 of FIG. 7. The breathing to retainer 700 includes a mask attachment portion 720 configured to connect the retainer to a face mask of a respirator. The retainer 700 also includes a tube attachment portion 740 that includes an arm 742 that connects the tube attachment portion to the mask attachment portion 720. The tube attachment portion 740 also includes a tube receiver 760 configured to receive a breathing tube of the respirator.

One difference between the breathing tube retainer 700 of FIG. 7 and breathing tube retainer 10 of FIG. 1-3 is that the arm 742 of the tube attachment portion 740 extends from a side portion of a ring 722 of the mask attachment portion 720 such that the arm is configured to extend over a side portion of a head of a user. Another difference is that a strap receiver 750 of the tube attachment portion 740 is configured to connect to a strap 726 of the mask attachment portion 720 such that the strap 726 is configured to extend around another side portion of the head of the user. Specifically, in one or more embodiments, a tab 732 of strap 726 of the mask attachment portion 720 is configured to be inserted into a slot 756 of the strap receiver 750. The straps 726 of the mask attachment portion 720 also includes a barb 733 that has a width greater than a width of the slot 756 such that the tab 732 is retained within the slot of the strap receiver 750 when the barb is pulled through the slot.

Another difference between breathing tube retainer 700 and breathing to retainer 100 is that the tube receiver 760 of the tube attachment portion 740 extends in a direction transverse to the arm 742. This position of the tube receiver 760 allows the retainer 700 to be configured to position a breathing tube adjacent to a shoulder and neck of a user of the respirator.

In one or more embodiments, the breathing tube retainer 700 can allow a user to wear a helmet because the retainer is retained on the head of the user by straps that extend around side portions of the head and not over a top portion of the head.

The breathing tube retainer 700 also includes one or more handles 734 that extend from the ring 722 of the mask attachment portion 720. Such handles 734 can allow a user to more easily attach the mask attachment portion 720 to the face mask or remove the mask attachment portion from the face mask. In one or more embodiments, a handle 744 can also extend from the tube receiver 760 such that a user can more easily grasp the receiver while inserting a breathing tube through passage 762 of the receiver. Further, in one or more embodiments, another handle 758 can be provided that extends from the strap receiver 750. Such handle 758 can aid the user in holding the strap receiver 750 while the tab 732 of the strap 726 is inserted into the slot 756 of the strap receiver 750.

Figure 8:
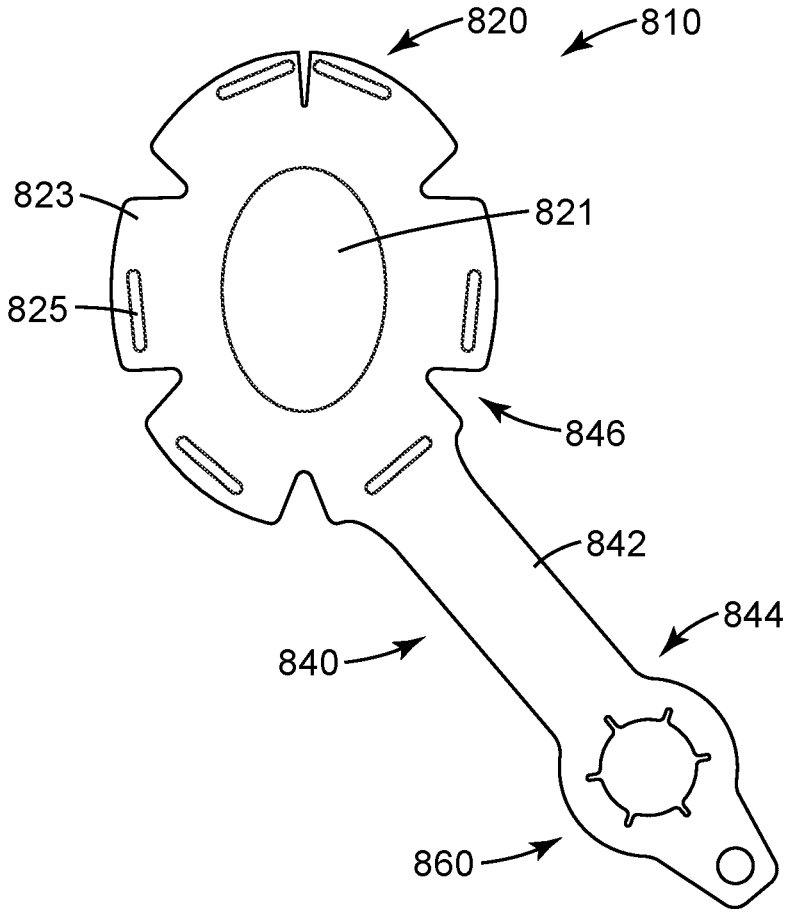
FIG. 8 is a schematic plan view of another embodiment of a breathing tube retainer.
Figure 9:
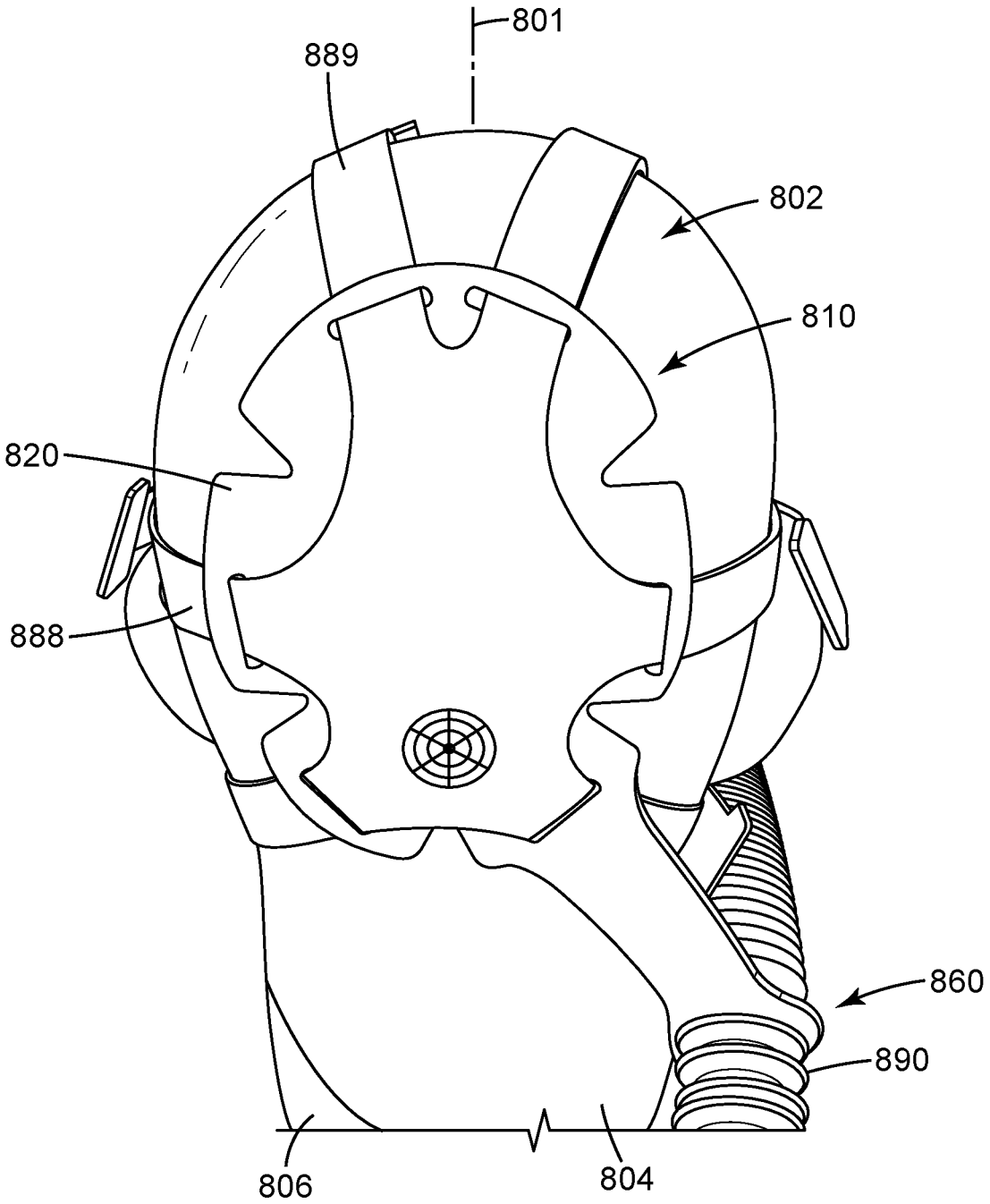
FIG. 9 is a schematic rear view of a respirator that includes the breathing tube retainer of FIG. 7.

As mentioned herein, the disclosed breathing tube retainers can be attached to any suitable element or portion of the respirator. For example, in one or more embodiments, the breathing tube retainer can be attached to a helmet instead of a face mask. Further, for example, a breathing tube retainer can be attached to a harness of a face mask. For example, FIGS. 8-9 are schematic views of another embodiment of a breathing tube retainer 810. Specifically, FIG. 8 is a schematic plan view of retainer 810, and FIG. 9 is a schematic rear view of the retainer attached to a face mask 880 of a respirator 800. All of the design considerations and possibilities regarding the breathing tube retainer 10 of FIGS. 1-3 apply equally to the breathing tube retainer 810 of FIGS. 8-9. Further, all design considerations and possibilities regarding the respirator 400 of FIGS. 4-5 apply equally to the respirator 800 of FIG. 9. One difference between retainer 10 and retainer 810 is that retainer 810 is configured to be attached to a harness 888 of a face mask (not shown). In the embodiment illustrated in FIGS. 8-9, a mask attachment portion 820 is configured to be attached or connected to the harness 888 of the face mask. The harness 888 includes straps 889. The straps 889 are fed through one or more slots 825 formed in tabs 823 of the mask attachment portion 820 of the retainer 810.

The breathing tube retainer 810 also includes a tube attachment portion 840 that includes an arm 842 that connects the tube attachment portion to the mask attachment portion 820. The tube attachment portion 840 also includes a tube receiver 860 configured to receive a breathing tube 890 of the respirator 800. Unlike the retainer 10 of FIGS. 1-3, the arm 842 of the retainer 810 of FIGS. 8-9 does not include a bend. Instead, the breathing tube retainer 820 is configured such that the arm 842 extends along a direction 802 that forms an angle θ with a central axis 801 of a head 803 of a user such that the breathing tube 890 can be retained adjacent a shoulder 806 of the user, e.g., the right shoulder. Any suitable angle θ can be formed between central axis 801 and direction 803.

As mentioned herein, the mask attachment portion 820 can take any suitable shape or combination of shapes. For example, mask attachment portion 820 includes an opening 821 that allows the retainer 800 to more easily conform to the shape of the head 802 of the user. The opening 821 can take any suitable shape or combination of shapes.

Although the above discussion describes clean breathable air being supplied by a supplied air respirator, it may also be possible for the clean air to be supplied to the user's face mask through an air regulator that supplies clean air to the user from either low or high pressure systems. In such a device, the user typically wears the regulator on a belt, the connection being made between the regulator and the face mask by the breathing tube described herein. The regulator receives its air supply through a flexible adjustable length breathing tube from either a lower or high pressure supply where low pressure typically comes from an air pump and where high pressure typically comes from an air compressor. A known regulator product has been marketed under the brand Flowstream™ by 3M, and such products have used wide bore breathing tube (diameter greater than about 3 cm, typically about 2 to 5 cm) for the connection between the regulator and the face mask. For purposes of this disclosure, a breathing tube that is connected to a clean air supply source through a regulator or other device is considered to be a tube that "extends from" the clean air supply source to the face mask.

All references and publications cited herein are expressly incorporated herein by reference in their entirety into this disclosure, except to the extent they may directly contradict this disclosure. Illustrative embodiments of this disclosure are discussed and reference has been made to possible variations within the scope of this disclosure. These and other variations and modifications in the disclosure will be apparent to those skilled in the art without departing from the scope of the disclosure, and it should be understood that this disclosure is not limited to the illustrative embodiments set forth herein. Accordingly, the disclosure is to be limited only by the claims provided below.

What is claimed is:

1. A breathing tube retainer comprising:

a mask attachment portion configured to connect the retainer to a face mask of a respirator; and a tube attachment portion comprising an arm that connects the tube attachment portion to the mask attachment portion, wherein the tube attachment portion further comprises a tube receiver configured to receive a breathing tube of the respirator, wherein the retainer is configured to position the breathing tube adjacent a shoulder and neck of a user of the respirator.

2. The retainer of claim 1, wherein the arm comprises an adjustable buckle configured to connect the tube attachment portion to the mask attachment portion.

3. The retainer of claim 1, wherein the arm comprises a y-portion comprising first and second strap receivers configured to receive first and second straps of the mask attachment portion.

4. The retainer of claim 1, wherein the tube receiver comprises a passage configured to receive the breathing tube of the respirator.

5. The retainer of claim 4, wherein the tube receiver is disposed adjacent a first end of the arm of the tube attachment portion, and wherein the tube attachment portion further comprises first and second strap receivers adjacent a second end of the arm.

6. The retainer of claim 5, wherein the mask attachment portion comprises first and second straps configured to attach the mask attachment portion to the tube attachment portion at the first and second strap receivers of the tube attachment portion.

7. The retainer of claim 6, wherein the first and second strap receivers are adjustable.

8. The retainer of claim 1, wherein the mask attachment portion comprises a ring configured to engage a perimeter of a lens of the face mask of the respirator and attach the retainer to the mask.

9. The retainer of claim 1, wherein the tube attachment portion comprises a second tube receiver.

10. The retainer of claim 1, wherein the mask attachment portion is integral with the tube attachment portion.

11. The retainer of claim 1, wherein the retainer is configured to position the breathing tube above a shoulder of a user of the respirator such that the breathing tube does not touch the shoulder when the respirator is worn by the user.

12. The retainer of claim 1, wherein the retainer is configured to be positioned over a head of the user of the respirator.

13. A supplied air respirator comprising:

a clean air supply source designed to be carried by a user of the supplied air respirator;

a face mask sized to fit at least over the user's nose and mouth;

a breathing tube configured to connect the clean air supply source to the face mask; and a breathing tube retainer comprising:

a mask attachment portion connected to the face mask; and a tube attachment portion comprising an arm that connects the tube attachment portion to the mask attachment portion, wherein the tube attachment portion further comprises a tube receiver, wherein the breathing tube is positioned within the tube receiver, wherein the retainer is configured to position the breathing tube adjacent a shoulder and neck of a user of the respirator.

14. The respirator of claim 13, wherein the breathing tube retainer is configured to retain the breathing tube such that it extends from the face mask, over a shoulder of the user adjacent a base of a neck of the user, and down a back of the user when the respirator is worn by the user.

15. The respirator of claim 14, wherein the breathing tube retainer is further configured to position the breathing tube over the shoulder of the user without the breathing tube contacting the shoulder.

16. The respirator of claim 13, wherein the tube receiver of the tube attachment portion of the breathing tube retainer further comprises a passage that retains the breathing tube.

17. The respirator of claim 13, wherein the mask attachment portion is connected to a harness of the face mask.

18. The respirator of claim 13, wherein the mask attachment portion is attached to a perimeter of a lens of the face mask.

19. A method of using a respirator, comprising:

attaching a breathing tube retainer to a face mask of the respirator;

attaching a first end of the breathing tube to the face mask;

inserting a second end of the breathing tube through a passage of a tube receiver of the breathing tube retainer;

attaching the second end of the breathing tube to a clean air supply source; and placing the face mask over a nose and mouth of a user, wherein the breathing tube extends from the face mask, over a shoulder of the user, and to the clean air supply source, wherein the retainer is configured to position the breathing tube adjacent a shoulder and neck of a user of the respirator.

* * * * *